US010665213B2

(12) United States Patent
Sidell et al.

(10) Patent No.: US 10,665,213 B2
(45) Date of Patent: May 26, 2020

(54) DRUM RING KIT

(71) Applicants: Patrick Sidell, Wilmington, DE (US); Christopher Wells, Newark, DE (US); Elliott Sidell, Wilmington, DE (US)

(72) Inventors: Patrick Sidell, Wilmington, DE (US); Christopher Wells, Newark, DE (US); Elliott Sidell, Wilmington, DE (US)

(73) Assignee: ES DRUM RING LLC, Wilmington, DE (US)

( * ) Notice: Subject to any disclaimer, the term of this patent is extended or adjusted under 35 U.S.C. 154(b) by 0 days.

(21) Appl. No.: 16/509,049

(22) Filed: Jul. 11, 2019

(65) Prior Publication Data

US 2019/0333485 A1 Oct. 31, 2019

Related U.S. Application Data

(63) Continuation of application No. 15/753,829, filed as application No. PCT/US2016/051200 on Sep. 11, 2016, now Pat. No. 10,380,981.

(60) Provisional application No. 62/217,854, filed on Sep. 12, 2015.

(51) Int. Cl.
*G10D 13/02* (2020.01)

(52) U.S. Cl.
CPC ..... *G10D 13/023* (2013.01); *G10D 13/02* (2013.01); *G10D 13/026* (2013.01)

(58) Field of Classification Search
CPC ..... G10D 13/023; G10D 13/02; G10D 13/026
USPC ..... 84/411 R
See application file for complete search history.

(56) References Cited

U.S. PATENT DOCUMENTS 7,777,112 B2 * 8/2010 O'Connor ..... G10D 13/023 84/411 A

* cited by examiner

*Primary Examiner* — Jianchun Qin
(74) *Attorney, Agent, or Firm* — Devlin Law Firm LLC; James M. Lennon

(57) ABSTRACT

This invention details a universal, self-contained, removable head and ring system for upgrading or nesting your acoustic musical drum kit.

6 Claims, 8 Drawing Sheets

DRUM RING KIT

CROSS REFERENCE TO RELATED APPLICATIONS

This application is a continuation of U.S. patent application Ser. No. 15/753,829 filed Feb. 20, 2018, which is a national stage entry application under 35 U.S.C. § 371 of International Patent Application No. PCT/US2016/051200 filed Sep. 11, 2016, which claims the benefit of priority under 35 U.S.C. § 119(e) to U.S. Provisional Application No. 62/217,854 filed Sep. 12, 2015, the entireties of which are incorporated by reference herein.

FIELD OF THE INVENTION

The invention is directed to a universal, self-contained, removable head and ring system for upgrading or nestling your acoustic musical drum kit.

BACKGROUND OF THE INVENTION

Transporting and setting-up drum sets is a time consumer and clumsy task which can cause damage to the drum set resulting in additional costs. Drums are large and the "heads" are fragile both in regard to structure and tuning issues. It is the desire of every drummer who plays professionally, semi-professionally, weekend warriors or bar gig players to dramatically reduce the number of items needed to bring to the venue, saving space to transport and time to set up and break down.

The current and/or most commonly used standard for tuning drums is best depicted by U.S. Design Pat. Fuji D350,362 referred to as the drum hoop. It includes a plurality of evenly spaced holes for bolts to be inserted through, in order to exert tension on the drum head, and having an overall shape designed to fit over the drum head. U.S. Design Pat. D339,818 provides an example of lugs which are fastened to the drum shell and/or serve as anchors for the bolts inserted through the drum hoop previously described.

Using traditional drum hoops and methods, to evenly apply tension to the drum head to set the correct pitch takes a great amount of time and skill, often being time consuming and frustrating. To deal with this problem, systems for tuning drums have been proposed to simplify this common task. For example, U.S. Pat. No. 4,218,952 is comprised of a large counter-hoop with a plurality of inward facing slides angled to act as ramps which ride on rollers or matching opposing slides fastened to the drum shell. It is tuned by rotating the counter-hoop clockwise or counterclockwise using a rack and pinion activation system. U.S. Pat. No. 5,719,448 is comprised of an inverted J-shaped counter-hoop, which engages an externally threaded, outwardly facing tuning rim surface on a tuning collar that is secured to the drum shell. Clockwise or counterclockwise rotation of the counter-hoop is accomplished by a pair of gears, one for gross tuning, and/or one for fine tuning. U.S. Pat. No. 7,777,112 uses an outer ring attached to the drum shell with threads on the inner diameter. An inner ring which has a thread on the outside diameter engages the outer ring's threads. A lower inner ring which is separated by ball bearings rides on the rim of the drum head. Rotating the inner ring increases or decreases the tension on the drum head.

Tuning was described in U.S. Pat. No. 7,138,574, having three annular members o-rings. The first annular member is the cam ring, which utilizes a single spiraling track or helical around its outside diameter, starting at the top of the spiral cam ring, spiraling down and exiting at the bottom, and is fastened to the cylindrical drum shell in the vicinity near the open end of the drum shell. The second ring is a smaller inner counter-hoop having vertical and horizontal surfaces which form an L cross section. The third ring is a larger outer rotating actuator ring having an inward facing horizontal surface atop the vertical surface forming an inverted cross section and encompasses the spiral cam ring parallel to the spiral track or helical at its outside diameter. Inward facing rollers or wheels mounted on its vertical surface of the inside diameter engages the track or helical of the cam ring. The rotating actuator's inverted L cross section overlaps the L cross section of the inner counter-hoop, and the two rings are separated by bearings or rollers to reduce friction while twisting the rotating actuator ring clockwise or counter-clockwise. The camming effect increases or decreases the downward force on the inner counter-hoop which bears down on the outer rim of the drum head when fitted over the open end of the drum shell, thereby tuning the drum. Further, U.S. Pat. No. 7,501,567, includes a method for attaching the tuning system to a drum shell and uses eccentrics on the lugs to raise and/or lower the cam ring. A horizontal radius plate with holes for a drum stick is included to engage and/or be used as a leverage point stationary in relation to the drum shell. In the '567 patent a tool was devised which hooked on "cleats" mounted on the lower vertical walls of the rotation actuator ring. A drum stick can be used for leverage against the tool while engaging the holes in the stationary radius plate and thereby facilitates movement of the rotating actuator ring, which in turn tunes the drum.

There still exists today the need for a drum system that provides packaging and transportation efficiency to save time and space while providing an effective means of tuning upon assembly.

BRIEF SUMMARY OF THE INVENTION

The invention is directed to a universal, self-contained, removable head and ring system for upgrading or nesting an acoustic musical drum kit.

In a first embodiment the invention is directed to a drum ring tuning system having an adjustable tuning ring in contact with a drum skin, at least one additional ring and a securing device which contacts the adjustable tuning ring and the at least one additional ring; the securing device being a bolt.

In another embodiment the invention is directed to a drum ring tuning system having an adjustable tuning ring in contact with a drum skin, at least one additional ring and a securing device which contacts the adjustable tuning ring and the at least one additional ring; the securing device being complementary ridges on the at least one additional ring and the adjustable tuning ring.

In another embodiment, the invention is directed to a ring system which can continually monitor and maintain the pitch and tension of a musical drum head affixed to the invention.

In yet another embodiment the invention is directed to a method to assemble and disassemble the system of the present invention, wherein the system allows the drum skin to maintain its "tune" based on the construction and components of the system.

DETAILED DESCRIPTION OF THE INVENTION

Certain terminology is used herein for convenience only and is not to be taken as a limitation on the present invention. The terminology includes the words specifically mentioned, derivatives thereof and words of similar import. The embodiments discussed herein are not intended to be exhaustive or to limit the invention to the precise form disclosed. These embodiments am chosen and described to best explain the principle of the invention and its application and practical use and to enable others skilled in the art to best utilize the invention.

The invention is a drum ring system which is a fully tunable ring type system that converts into a nesting kit; therefore making a drum set compact for transportation and storage. Most particularly, the invention is directed to a drum ring tuning system having an adjustable tuning ring in contact with a drum skin and at least one additional ring. A securing device in contact with the adjustable tuning ring and the at least one additional ring provide the ability to adjust tension on the drum skin/head to produce and control the desired sound.

Due to the construction of the ring components being made of wood or a variety of plastic or neoprene, all ring system components also bring an additional spectrum of sounds when played.

Figure 1:
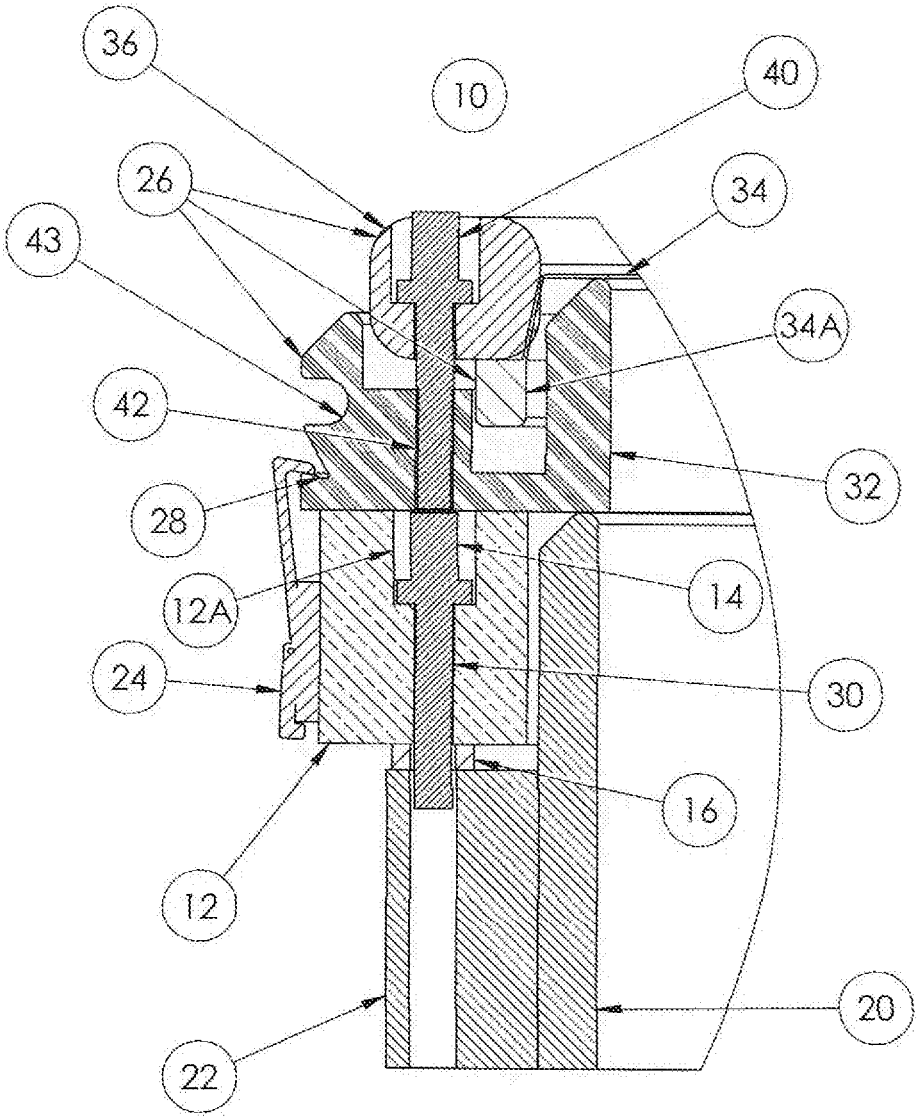
FIG. 1 is a partial cross-section of a first embodiment of the invention.
Figure 2:
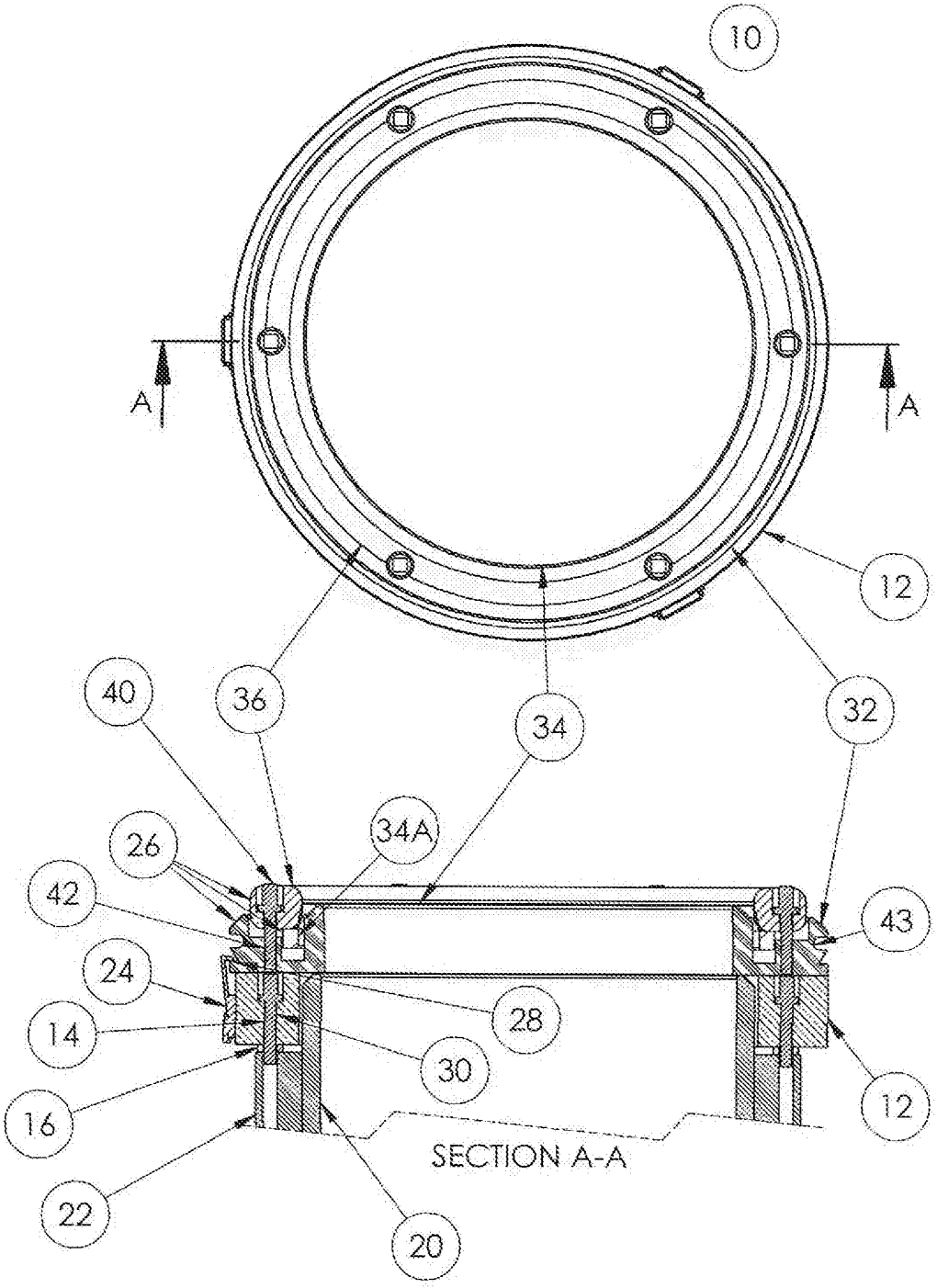
FIG. 2 is a cross-section of a first embodiment of the invention taken along the line A-A.
Figure 3:
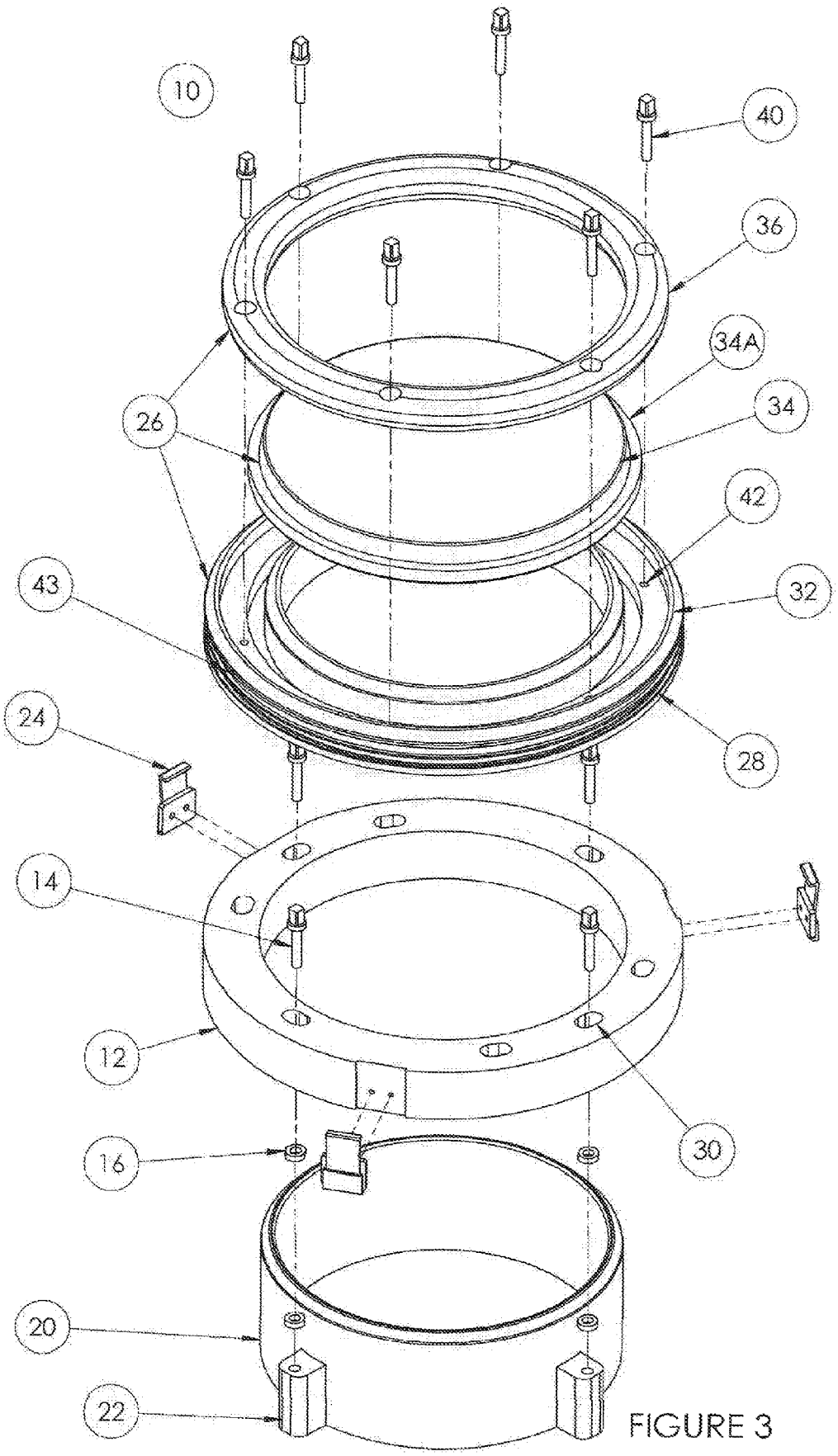
FIG. 3 is an exploded perspective view of a first embodiment of the invention.

Referring to FIGS. 1-3, in a first embodiment, the invention is directed to the drum ring system 10 made up of three rings. First, the lower ring 12 is designed with a slotted section 12A to provide a flush or slightly recessed area for the mounting lug 14 to be applied. An oval penetration 30 from the bottom of the slotted section 12A through the bottom of lower ring 12 allows the lower ring 12 to be mounted via the mounting lug bolts 14 onto most any existing ring mount pattern used on musical drums by most manufacturers in the Industry. Custom spacers 16 are used as standoffs potentially having a custom length. These spacers provide a means for the lower ring 12 to be mounted to the existing drum lugs/hoop lug receivers 22 that are typically mounted at different heights on different drums. The top of the lower ring 12 needs to be at a specific location relative to the top of the drum. Therefore, a custom spacer 16 is needed to bring the lower ring 12 to the correct height. It will be recognized the spacer 16 will be different for different types of drums. The custom spacers 16 provided in this design will allow solid mounting of the lower ring 12 to standard drums with existing hoop lug receivers 22. These receivers 22 are located at various intervals around the circumference of drum shell 20, the number of receivers 22 being determined by the size or circumference of the drum. This design provides a slotted ring that will accommodate any standard drum design.

Assembly of the system 10 is most commonly from the bottom up, shell mounted lug receiver 22, custom spacer 16, lower ring 12, mounting lug 14 with an optional washer, tightened by a drum key. This lower ring 12 may sit on a secured custom spacer 16. This lower ring 12 is the foundation for securing the upper ring assembly 26. The lower ring 12 also serves as the mounting surface for quick release clamps 24. These clamps 24 are needed to secure the upper ring assembly 26 to the lower ring 12. The clamps 24 are to be attached to the outside of the lower ring 12 in locations that will mirror the clamp receiver assembly 28 located on the outside of the upper ring 26.

The upper ring assembly 26 is a removable, split ring system consisting of a lower mounted drum head receiver ring 32. The receiver ring 32 is held affixed by quick release clamps 24 which fasten it to the lower ring 12. This receiver ring 32 is designed to serve as the mounting frame for the drum head 34 and the upper tuning ring 36. When the drum head 34 is positioned within the upper tuning ring 36, the tuning ring 36 is then placed on top.

The receiver ring 32 has receiver inserts 42 to allow for the tuning ring 36 to be fastened to it. The tuning ring 36 fits over the drum head 34 and is fastened into the receiver ring 32 with the upper lug bolts 40.

The top ring or tuning ring 36 is an adjustable, tunable, drum head mounting ring. This tuning ring 36 is attached through the use of upper lug bolts 40 and coordinated receiver inserts 42 located in the receiver ring 32 of the upper ring assembly 26. When the tuning ring 36 is placed above the drum head 34, tension is applied to the drum head 34 by tightening the upper lug bolts 40. When the tension of the drum head 34 is tuned to the desired note, installation is complete. More particularly, when the tuning ring 36 is tightened down on the drum head 34 it increases the tension in the drum head 34 and makes the frequency of the sound higher when the drum is struck. Loosening the tuning ring 36 allows the tension in the drum head 34 to decrease and makes the frequency of the sound lower when the drum is struck.

The invention will now be described in an additional embodiment wherein like reference numbers are meant to illustrate like features.

Figure 4:
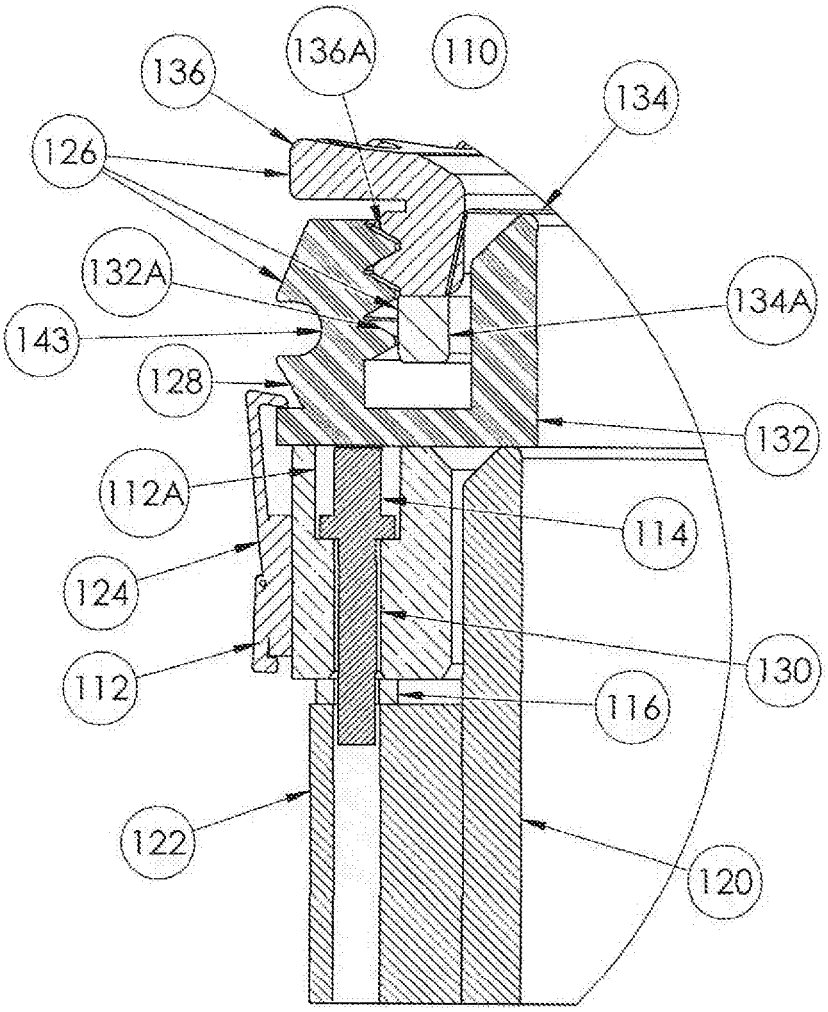
FIG. 4 is a partial cross-section of another embodiment of the invention.
Figure 5:
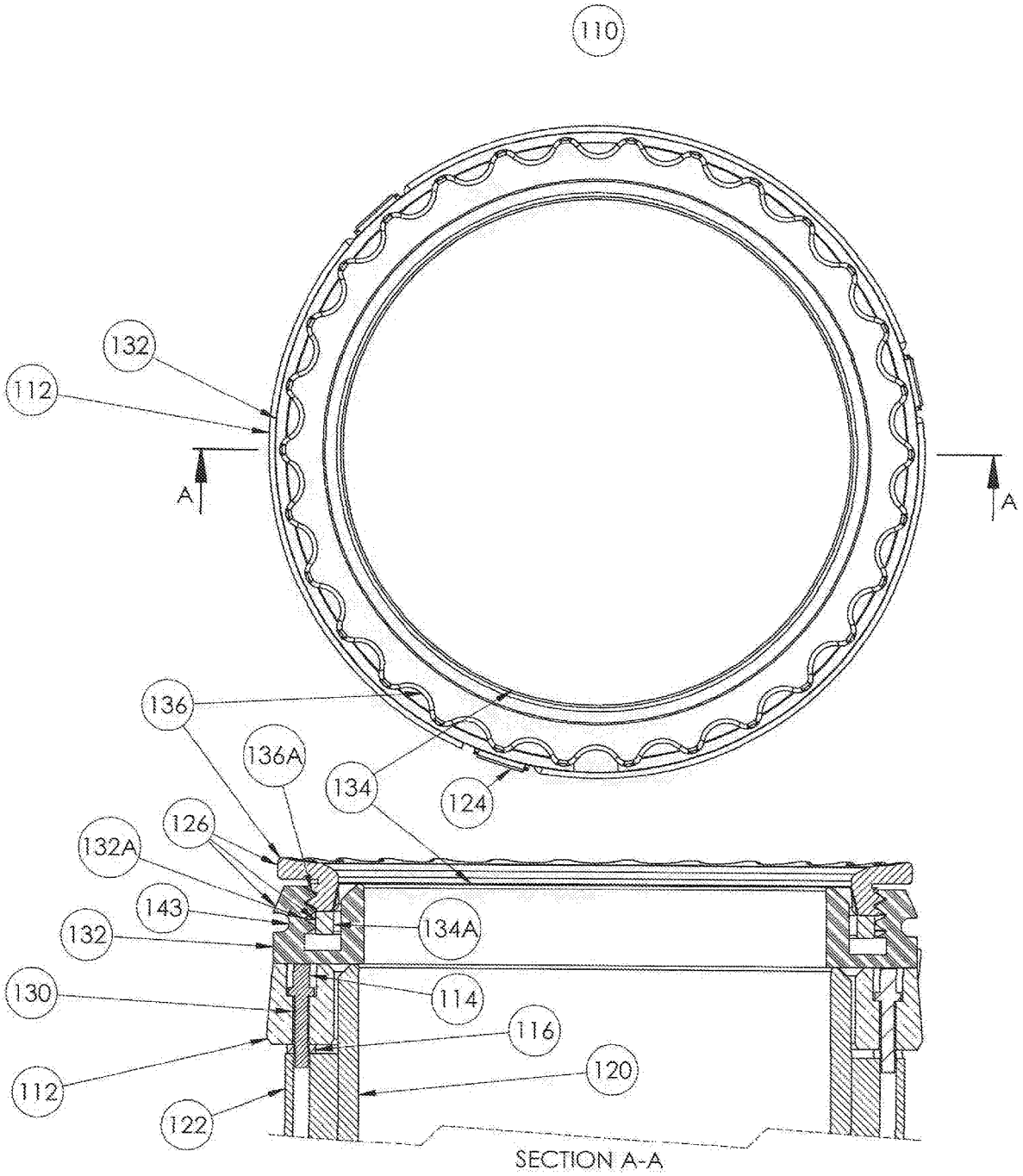
FIG. 5 is a cross-section of the embodiment of FIG. 4 taken along the line A-A.
Figure 6:
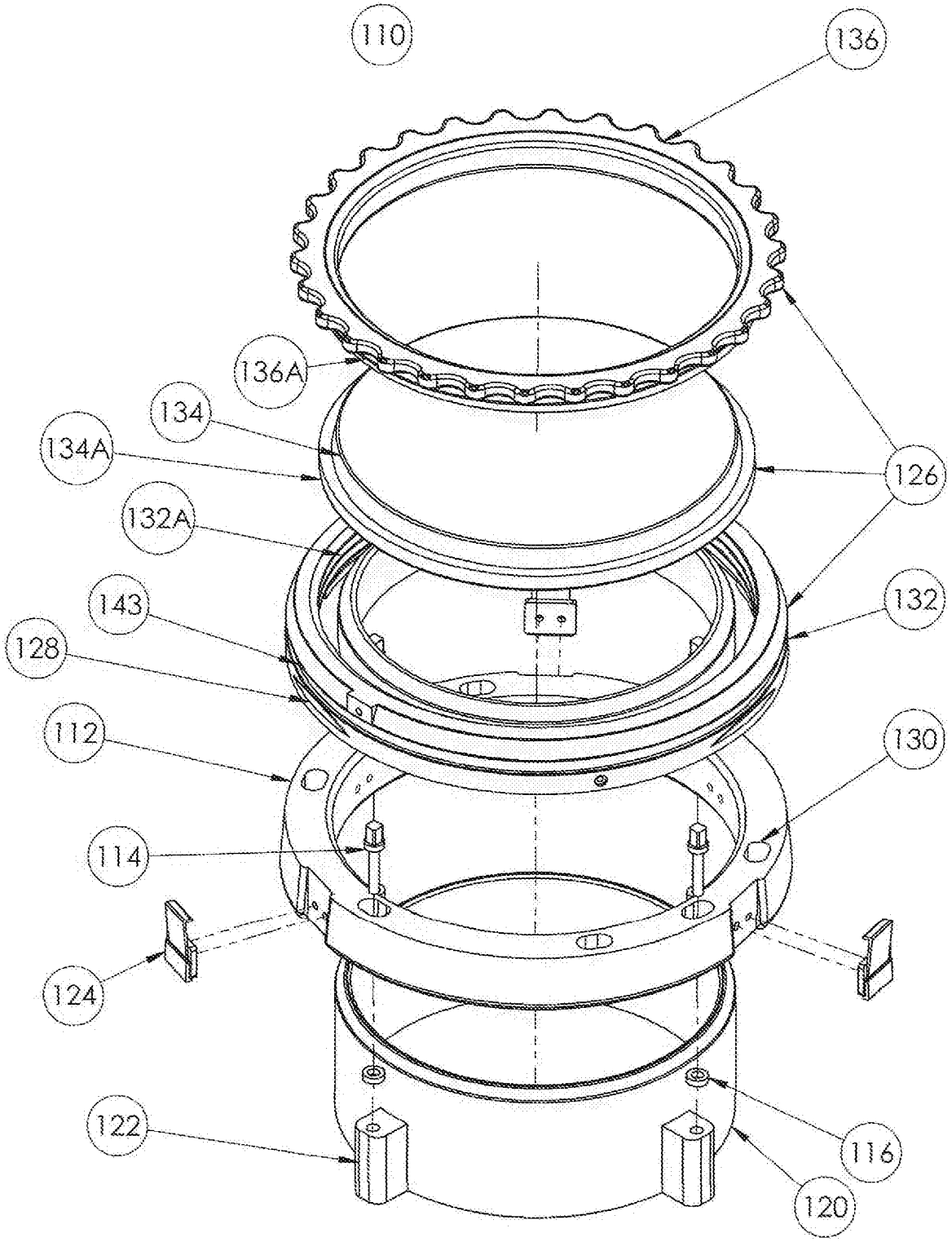
FIG. 6 is an exploded perspective view of the embodiment of FIG. 4.

Referring to FIGS. 4-6, in another embodiment, the tuning ring 136 has a defined inner diameter to be positioned on top of the ring 134A that is part of the drum head 134, but it does not cover the skin of the drum head 134. Further, the outer diameter of the tuning ring 136 has external threads 136A. The external threads 136A on the timing ring 136 interface with internal threads 132A on the lower receiver ring 132. As the tuning ring 136 is threaded into the lower receiver ring 132 it applies an even force on the drum head 134. The tuning ring 136 can be turned in order to adjust the resulting force which changes the tension in the drum head 134 and produces a desired sound when the drum is played. At that point the drum head 134 is recognized to be correctly properly in tune or "tuned."

One skilled in the art will recognize the difference in the embodiments described in the previous paragraphs as how force is applied to the drum head 34, 134 in order to create a specific tension to achieve a desired sound when the drum is played. In both embodiments, the tuning ring 36, 136 is used to apply this force. However, it is designed differently in these two embodiments, and therefore force is applied to them differently. In the first embodiment, as provided herein, the tuning ring 36 is a ring of material that has the correct inner diameter to rest on top of the ring 34A that is part of the drum head 34, but it does not cover the skin of the drum head 34. It also has the correct outer diameter to slide inside the receiver ring 32. The tuning ring 36 has multiple counterbored thru holes that align with lug receiver inserts 42 in the receiver ring 32. When upper tension lugs 40 are inserted through the tuning ring 36 and threaded into the lug receiver inserts 42, the tuning ring 36 and the lower receiver ring 32 are drawn together, which applies a force on the drum head 34. If all of the upper tension lugs 40 are tightened evenly to a correct torque, it is recognized as properly in tune ("tuned") and a desired sound will be produced when the drum is played.

Figure 7A:
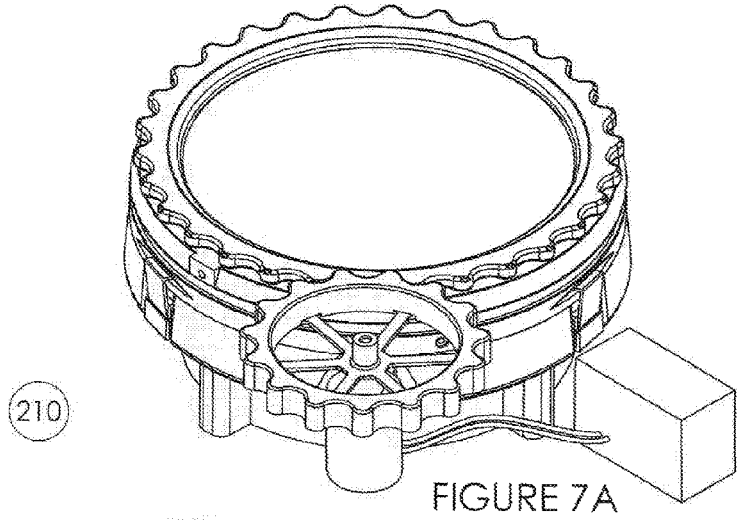
FIG. 7A is a perspective view of the embodiment of FIG. 7.
Figure 7B:
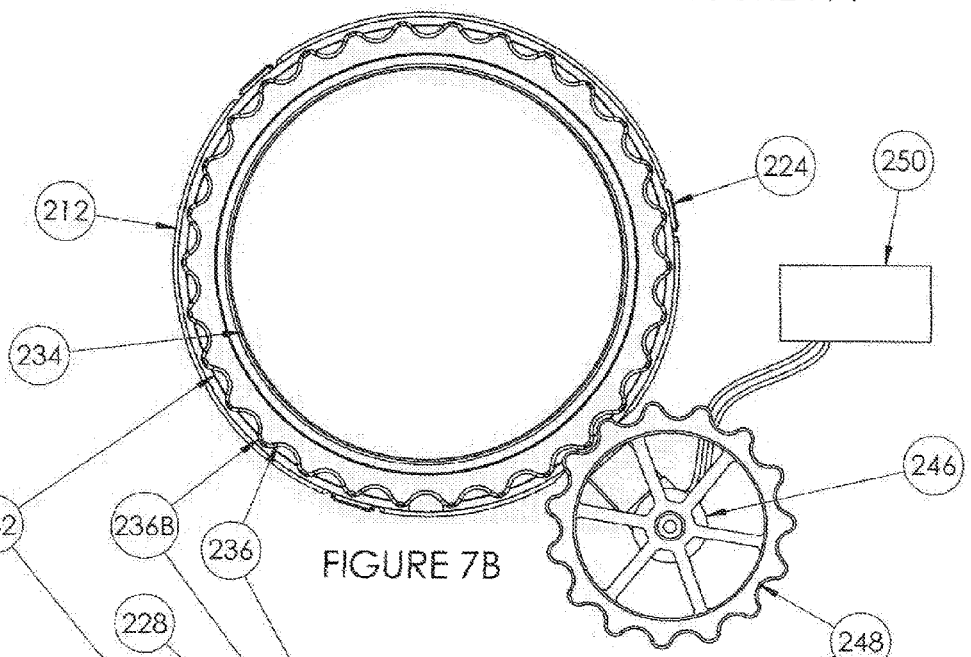
FIG. 7B is a top view of the embodiment of FIG. 7.
Figure 7:
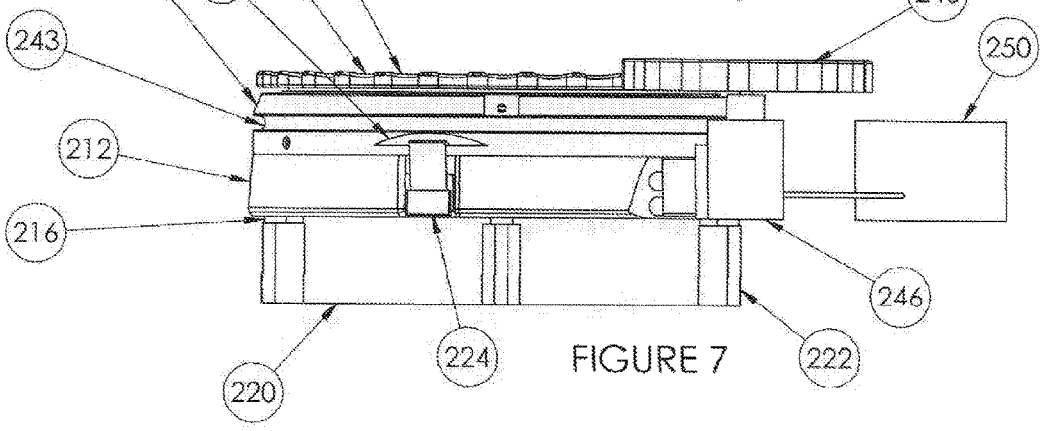
FIG. 7 is a side view of an alternate embodiment of the embodiment of FIGS. 4-6.
Figure 8:
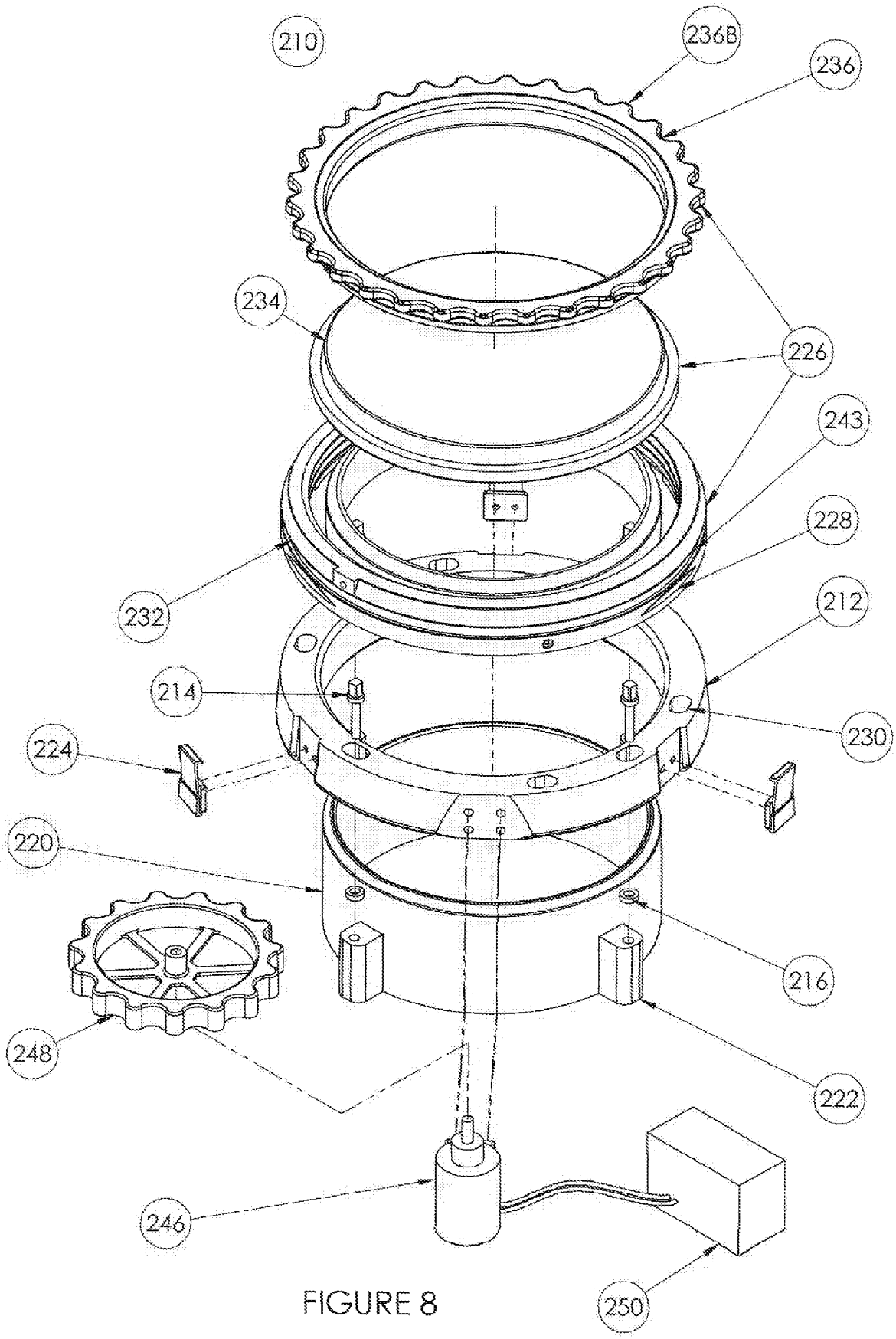
FIG. 8 is an exploded view of the embodiment of FIG. 7.

Referring to FIGS. 7 and 8, in another embodiment, the invention is directed to a ring system which can continually monitor and maintain the pitch and tension of a musical drum head affixed to the invention. Powered by battery or DC plug in, sensors will signal a motor to operate a mechanical screw type, clamp type, vector type, vacuum type, suction type or any other mechanical or pneumatic system utilized to apply and reduce tension to a drum head to attain correct tune. This system will enable the user to play a musical drum set while maintaining perfect pitch or tune set by the user allowing auto-adjusting of the tune of any drum head affixed to it, this feature will be referred to as "Auto-Tune." Auto-Tune can be a software driven system that when triggered by sensors will operate mover or movers, e.g., an electronically controlled physical device (such as a motor or pneumatic system). The mover or movers will eliminate the need for the drum to be tuned with a drum key.

A programmable panel, pad or even a smart phone app is used to adjust the drum tuning on the fly as the user is performing. This pre-programmable pad is used to enhance the arena of sound available to him, especially during a solo. It will also have a variety of preset modeling sounds to provide the user instant tune correction within the drum's natural tonality to accompany a given piece of music or closely copy the sound and tone of several popular drummers on the music scene.

Auto-Tune works by a mobile application or computer software "app" on a controller, e.g., any electronic hardware that allows the user to program or control the Auto-Tune system, including but not limited to, a mobile device (cell phone, tablet, etc.), a hand held gaming system style controller, or a radio controlled car style controller for monitoring the drum through a microphone, vibration sensor, accelerometer and/or drum head tension sensor, as the drum is played. The app then sends a signal to the electronic control hardware 250 which has one or more circuit boards, one or more microchips and a collection of other electronic parts that control the mover or movers, that are used to exert a force on the system. Further, the electronic control hardware 250 can control lights mounted on the drum ring system, sense environmental conditions (such as light, vibration, temperature and sound), and communicate with the app running on the controller in either a wired configuration or a wireless configuration. Core to the function of the invention, the electronic control hardware 250 will cause a mover or movers to move the tuning ring 36, 136, 236 of the various embodiments, and achieve a desired sound.

Referring to FIGS. 7 and 8, a non-limiting example of how this is achieved in the embodiment illustrated in FIGS. 4-6. A motor 246 is mounted on the lower ring 212. The motor 246 includes a gear 248 mounted thereto that interfaces with the gear-tooth-like features 236B on the outer diameter of the tuning ring 236. The app (not shown) running on the controller (not shown) "listens" through a microphone (not shown) for the drum system 210 to be played. Based on what the app "hears," it sends a signal to the electronic control hardware 250 through a wireless Bluetooth Low Energy connection to direct the direction and speed to activate the motor 246. The electronic control hardware 250 causes the motor 246 to "turn," which turns the gear 248, which turns the tuning ring 236. The tension in the drum head 234 changes as the tuning ring 236 turns. The sound of the drum changes as the tension changes as desired by the user/drummer of the system 210. The user continues to play the drum, and the app continues to listen; this cycle continues until the motor 246 has positioned the tuning ring 236 to the correct position for the drum head 234 to produce the sound that the app has been programmed to require from the system 210. At that point the tension in the drum skin 234 is reasonably consistent across the drum skin, and that tension produces a specific desired sound when the drum is played "in tune."

One skilled in the art would recognize the Auto-Tune functionality described herein can be used in conjunction with the first embodiment provided herein; however, in the first embodiment, all of the upper tension lugs 40 need to be turned individually to a correct torque in order to produce a desired sound and correctly "tune" the drum. For this system to be tuned by motors or other means, each of those upper tension lugs 40 need to be turned.

The Auto-Tune features of the present invention enable an acoustic drum to produce sound in a way that was not previously possible. This new sound is a result of a function called dynamic tuning. In dynamic tuning, the idea is that the mover or movers can be moved at any point in time, not only when the drum is being tuned at the beginning of a session or the beginning of a particular song. As a result, dynamic tuning can be used to change the drum head 234 from one tension to another while the drum is being played, as best illustrated in FIG. 7. This results in a sound similar to that of a "whammy bar" on a guitar. The triggers, movements and/or timings can be controlled by the app and/or electronic control hardware 250.

Dynamic tuning can be controlled in multiple ways by the app and/or electronic control hardware 250. First, it can be controlled by a predetermined, user-defined sequence of triggers, movements and/or timings. Second, it can be controlled by a freestyle user interface that would allow the drummer to improvise by changing the sound on the fly. Third, it can be controlled by environmental changes, such as lights, sounds, temperature, and/or other instruments. It can also be controlled by any combination of these three methods. Triggering of dynamic tuning can be done by a specific sound, drum strike, button press, touch screen press, cue from another instrument, light change, or other desired sensing method.

Referring again to the embodiment in FIGS. 7 and 8, each of the three individual control methods is explained with examples.

Predetermined User-Defined Sequence

Before play begins, the user enters a sequence of triggers, movements and/or timings into the app. An example of this sequence would be: Trigger a dynamic tuning sequence when the light in the room changes from white to red. Tighten the drum head for 0.2 seconds, remain there for 0.5 seconds, then loosen the drum head for 0.3 seconds and remain there until the sound in the room drops below 10 decibels, then tighten the drum head for 0.3 seconds. In an environmentally controlled period of time, the drum sound will have changed three times, and the drum may have been struck once or multiple times during that time period.

Freestyle User Interface

While the drum is being played, the user has access to an interface that allows changing of the tension in the drum head 234 on the fly. An example of this would be: using a slider widget in the app, the user can tighten the drum head or loosen the drum head in a free style fashion that does not require preset triggers or timings.

Environmental Changes

Before play begins, the user enters a specific set of environmental triggers and priorities into the app. An example of this would be: Any time the keyboard plays an "A" note, tighten the drum head for 1 second. This is priority 1. When priority 1 is not happening, if the light in the environment brightens to more than 350 millicandelas, tighten the drum head for 0.5 seconds. Conversely, when priority 1 is not happening, if the light in the environment dims to less than 350 millicandelas, loosen the drum head for 0.5 seconds.

In another embodiment a method is provided to assemble and disassemble the system. This method is based on the central concept of the present invention which provides a system that allows the drum skin to maintain its "tune" based on the construction and components of the system (in each embodiment) as described herein. Having the ability to remove the upper ring assembly 26, 126, 236, from the "drum shell," as illustrated best in the exploded figure views, allows the quick and efficient assembly and disassembly of the drum set while maintaining the "tune" of each of the drum heads that use this invention. Further, this allows the "nesting" of the various size drums in the drum set thereby providing the ability to reduce the amount of drum cases needed for transport.

In a non-limiting example, when one sizes a standard drum kit it may include several pieces and parts to be assembled and adjusted to prepare to actually play them. The typical kit for this system can vary slightly but provides these standard drums to be nested into one drum and so needing only one case! The assembly includes, but is not limited to, 22"×22" kick drum, 14"×16" Floor tom, 8"×10" tom tom, 6.5"×14" Snare drum.

The procedure is initiated by loosening all quick release clamps on a 14" tom tom drum and the kick drum, positioning the kick drum on its unopened ring end, placing the 8" tom tom inside the 14" tom tom, and replace the ring system. Then, the 14" tom tom is placed inside the 22" Kick drum and the 6.5" snare drum is placed on top of the 14" tom tom along with any thin padding as desired. Then all of the drums are placed into the 22" kick drum and the upper ring assembly 26, 126 on that drum is secured with quick release clamps, i.e., the 8" tom tom is packed into the 14" tom tom, which is packed into the 22" kick, with snare on top; all 4 drums now fit into one case.

The user of the system of the present invention will benefit many ways: first, the ease of opening and re-securing the ring assembly of the embodiments of the invention; second, the ability that nesting, e.g. storing a drum within a drum based on size, saves space when traveling; third, the fact that the drum head itself stays in tune longer, and fourth, the ability to have a drum set stored for transport in minimal space and "drum cases," allowing the user to convert almost any drum kit into a "nesting kit" without having to buy additional cases.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A drum ring tuning system comprising:

a mating pair of rings, comprising a tuning ring and a fixed ring assembly, wherein:

(i) the fixed ring assembly is releasably attachable to an exterior of a drum shell;

(ii) the fixed ring assembly contains a set of internal threads;

(iii) the tuning ring contains a set of external threads configured to mate with the internal threads of the fixed ring assembly;

(iv) the tuning ring is configured to sit atop a replaceable drum head which, as installed, extends across an upper circumference of the drum shell;

(v) the tuning ring is configured to rotate as a single unit; and (vi) the tuning ring is configured to achieve direct, frictional contact between the lower portion of the tuning ring and the upper portion of an outer ring of the replaceable drum head as the tuning ring is tightened into the threads of the fixed ring assembly so that tensioning pressure is applied to the drum head with rotational tightening of the tuning ring, wherein the tuning ring contains gear-teeth on the uppermost portion of the tuning ring along an outer circumference of the tuning ring, wherein the gear-teeth have peaks flaring outwardly relative to the outer circumference of the tuning ring such that the gear-teeth extend in a plane that is roughly parallel to a striking surface of an installed, replaceable drum head.

2. The system of claim 1, wherein the gear-teeth are finger-sized.

3. The system of claim 2, wherein the orientation of the gear-teeth, relative to the fixed ring assembly, is configured to allow room for manual engagement in order to apply a rotational force by hand to tighten and loosen the threads of the tuning ring through the threads of the fixed ring assembly.

4. The system of claim 3, wherein a portion of the gear-teeth of the tuning ring is mated to gear-teeth of a gear connected to a motor, which is connected to an automated tuner connected to an audio sensor.

5. The system of claim 1, wherein the tuning ring is made of a plastic material.

6. The system of claim 5, wherein the fixed ring assembly is made of a non-plastic material.

* * * * *